US007827625B2

(12) United States Patent
Morrow et al.

(10) Patent No.: US 7,827,625 B2
(45) **Date of Patent: *Nov. 9, 2010**

(54) PROTECTIVE ATHLETIC EQUIPMENT

(75) Inventors: David Morrow, Farmington, MI (US); Matthew Winningham, Birmingham, MI (US); Jesse Hubbard, New York, NY (US)

(73) Assignee: Warrior Sports, Inc., Warren, MI (US)

( * ) Notice: Subject to any disclaimer, the term of this patent is extended or adjusted under 35 U.S.C. 154(b) by 131 days.

This patent is subject to a terminal disclaimer.

(21) Appl. No.: 11/928,018

(22) Filed: Oct. 30, 2007

(65) Prior Publication Data

US 2008/0040841 A1 Feb. 21, 2008

Related U.S. Application Data

(60) Division of application No. 10/852,015, filed on May 24, 2004, now Pat. No. 7,487,556, which is a continuation of application No. 10/417,302, filed on Apr. 16, 2003, now Pat. No. 7,103,924.

(51) Int. Cl.
*A41D 13/00* (2006.01)

(52) U.S. Cl. ..... 2/463

(58) Field of Classification Search ..... 2/44, 2/102, 463, 455, 456, 108, 267, 69, 69.5, 2/2.5, 16, 22, 24, 465, 466, 467
See application file for complete search history.

(56) References Cited

U.S. PATENT DOCUMENTS

| | | | | |
|---|---|---|---|---|
| 1,277,706 | A | 9/1918 | Dorfman | |
| 3,561,436 | A | 2/1971 | Gaylord, Jr. | |
| 3,648,291 | A | 3/1972 | Pankers | |
| 3,789,842 | A | 2/1974 | Froimson | |
| 3,911,497 | A | 10/1975 | Lewis, Jr. et al. | |
| 4,014,327 | A | 3/1977 | Spiro | |
| 4,027,666 | A | 6/1977 | Marx | |
| 4,048,991 | A | 9/1977 | Marx | |
| 4,120,052 | A | 10/1978 | Butler | |
| 4,150,442 | A | 4/1979 | Boone | |
| 4,198,708 | A | 4/1980 | Fugere et al. | |
| 4,422,183 | A | 12/1983 | Landi et al. | |
| 4,441,211 | A | 4/1984 | Donzis | |
| 4,453,271 | A | 6/1984 | Donzis | |
| 4,467,475 | A | 8/1984 | Gregory et al. | |
| 4,484,361 | A | 11/1984 | Leighton et al. | |
| 4,513,449 | A | 4/1985 | Donzis | |
| 4,590,622 | A | 5/1986 | Wolfe et al. | |
| 4,642,814 | A | 2/1987 | Godfrey | |
| 4,722,099 | A * | 2/1988 | Kratz | 2/79 |
| 4,922,929 | A | 5/1990 | DeJournett | |

(Continued)

OTHER PUBLICATIONS

STX Lacrosse Catalog 2000: Prototype Athletic Equipment.

(Continued)

*Primary Examiner*—Tejash Patel
(74) *Attorney, Agent, or Firm*—Warner Norcross & Judd LLP

(57) ABSTRACT

A protective garment for a torso is disclosed herein. The protective garment includes a protector portion having an outer surface and an inner surface. The protective garment also includes a screen layer disposed below the outer surface.

20 Claims, 5 Drawing Sheets

U.S. PATENT DOCUMENTS

| | | | |
|---|---|---|---|
| 4,985,931 | A | 1/1991 | Wingo, Jr. |
| 5,159,715 | A | 11/1992 | Jurga et al. |
| 5,168,576 | A | 12/1992 | Krent et al. |
| 5,173,964 | A | 12/1992 | Ball et al. |
| 5,222,256 | A | 6/1993 | Wang |
| 5,445,385 | A | 8/1995 | Brooks |
| 5,449,341 | A | 9/1995 | Harris |
| 5,451,201 | A | 9/1995 | Prengler |
| D364,009 | S | 11/1995 | Engdahl |
| 5,472,769 | A | 12/1995 | Goerz, Jr. et al. |
| 5,530,966 | A | 7/1996 | West |
| 5,561,857 | A | 10/1996 | Hoshizaki et al. |
| 5,594,954 | A | 1/1997 | Huang |
| 5,623,728 | A | 4/1997 | Wagner |
| 5,652,967 | A | 8/1997 | Hsu |
| 5,716,120 | A | 2/1998 | Hung |
| D396,330 | S | 7/1998 | Oetting |
| 5,781,935 | A | 7/1998 | Bassett et al. |
| 5,865,775 | A | 2/1999 | Peoples et al. |
| 5,887,277 | A | 3/1999 | Lohman |
| D407,859 | S | 4/1999 | Rule |
| 5,925,010 | A | 7/1999 | Caprio, Jr. |
| D417,036 | S | 11/1999 | Hamowy |
| 6,035,453 | A | 3/2000 | Cain |
| 6,059,834 | A | 5/2000 | Springs |
| D426,678 | S | 6/2000 | Rule |
| D430,362 | S | 8/2000 | Pagotto |
| 6,098,196 | A | 8/2000 | Logan |
| 6,098,208 | A | 8/2000 | Cordon |
| 6,122,768 | A | 9/2000 | McCrane |
| 6,128,777 | A | 10/2000 | Foreman |
| 6,138,281 | A | 10/2000 | Chiaruttini |
| 6,182,288 | B1 | 2/2001 | Kibbee |
| 6,192,519 | B1 | 2/2001 | Coalter |
| 6,205,583 | B1 | 3/2001 | Beland |
| 6,216,268 | B1 | 4/2001 | Schleicher |
| 6,219,843 | B1 | 4/2001 | Passi et al. |
| 6,240,565 | B1 | 6/2001 | Spear |
| 6,243,867 | B1 | 6/2001 | Faison |
| 6,247,188 | B1 | 6/2001 | Beland |
| 6,295,654 | B1 | 10/2001 | Farrell |
| 6,328,706 | B1 | 12/2001 | Yattavong |
| 6,374,408 | B1 | 4/2002 | Tomlinson et al. |
| 6,398,749 | B1 | 6/2002 | Slautterback |
| 6,503,216 | B1 | 1/2003 | Thibodo, Jr. |
| 6,654,960 | B2 | 12/2003 | Cho |
| 6,807,680 | B2 | 10/2004 | Sloot |
| 6,839,910 | B2 | 1/2005 | Morrow et al. |
| 6,880,172 | B2 | 4/2005 | Quintero |
| 7,082,621 | B1 * | 8/2006 | Fratesi ..... 2/227 |
| 7,487,556 | B2 * | 2/2009 | Morrow et al. ..... 2/463 |
| 2002/0138896 | A1 | 10/2002 | Holden |
| 2003/0028947 | A1 | 2/2003 | Fee et al. |
| 2004/0045079 | A1 | 3/2004 | Quintero |

OTHER PUBLICATIONS

STX Lacrosse Catalog 2000; Elbow Pad.

* cited by examiner

PROTECTIVE ATHLETIC EQUIPMENT

CROSS-REFERENCE TO RELATED APPLICATIONS

This application is a divisional of U.S. patent application Ser. No. 10/852,015, for PROTECTIVE ATHLETIC EQUIPMENT, filed on May 24, 2004, now U.S. Pat. No. 7,487,556 which was a continuation of U.S. patent application Ser. No. 10/417,302, for PROTECTIVE ATHLETIC EQUIPMENT, filed on Apr. 16, 2003 and is now U.S. Pat. No. 7,103,924.

BACKGROUND OF THE INVENTION

1. Field of the Invention

The present invention relates generally to protective equipment for shielding a wearer's body from unwanted forces and potential injury. More particularly, the present invention relates to protective equipment having moveable armor modules for providing a wide range of unfettered body movement while providing maximum cushioning against blows imparted upon the upper body during athletic competition.

2. Description of Related Prior Art

Upper body protective equipment is commonly worn by participants of contact sports for the purpose of preventing injuries to their shoulders, back, and chest. These kinds of injuries ordinarily are associated with sports such as lacrosse, hockey, and football. In these contact sports, various situations may cause upper body injuries. Examples of these situations include tackling or otherwise bumping into other players, falling to the playing surface, being struck by another player's game equipment, or being struck by the game ball itself. Of course, upper body protective equipment may reduce or prevent injuries resulting from various other circumstances, including those not associated with contact sports.

Existing upper body protective equipment utilizes a relatively significant amount of foam padding for absorbing the energy of blows delivered to the wearer's upper body. Moreover, a rigid cover, typically made of plastic, usually overlays the foam padding to distribute the force of the blow across a larger area of the foam padding. As is known in the art, distributing the force in this manner permits the foam padding to absorb a substantial portion of the energy associated with the blow thereby preventing the force from being imparted directly to the wearer's body.

One drawback of foam padding is that the repeated compression and expansion of the foam padding may over time cause the foam padding to fatigue and lose its ability to absorb energy. Another drawback is that the combined use of the foam padding and the rigid cover adds relatively significant weight to the protective equipment. Heavier equipment is undesirable as it causes a wearer to expend more energy participating in the sport due to the burden of having to carry this additional weight.

Another drawback of existing upper body protective equipment is that the rigid cover can interfere with the free movement of the wearer's limbs. For example, a relatively large rigid cover can be utilized to protect the wearer's shoulder. The edge of this rigid cover can become sandwiched between the wearer's upper arm and his neck or simply pinch the wearer's neck as the wearer lifts his arm, e.g. when a lacrosse player begins to throw the lacrosse ball. This obviously causes significant discomfort to a wearer and can interfere with his ability to participate in the sport. Moreover, it is contemplated that the rigid cover can be positioned over other portions of the body and prevent the wearer from freely moving various other limbs. Attempts to provide protective equipment that provides increased freedom of movement for a wearer have resulted in a corresponding decrease in the amount of upper body protection provided. There is thus a tradeoff between freedom of movement and maximum protection.

Yet another drawback of existing protective equipment is that the contiguous rigid cover and foam combination typically forms a continuous section of padding that can substantially insulate the wearer's body. In other words, the protective equipment can form a thermal barrier that prevents heat from efficiently dissipating from the wearer's body. This thermal barrier can substantially increase the wearer's body temperature as he generates an increasing amount of heat during his participation in the game. This result is obviously disadvantageous because it can decrease the comfort level of the wearer, compromise his physical ability to participate in the sport, or even present a risk to the wearer's health.

Still another drawback of existing upper body protective equipment is that the equipment can include a series of external belt fasteners utilized for attaching separate padding sections of the garment together. These external belt fasteners are disadvantageous because they can provide a hold for opponents or otherwise allow for the opponent's equipment, e.g. lacrosse stick, to be caught thereon.

A further drawback of existing upper body protective equipment is that they can include separate portions of decorative fabric that are stitched together. Stitching these portions of fabric together is disadvantageous because it typically requires a substantial amount of time to stitch the fabric portions together. Moreover, the size of these stitched designs is limited due to conventional sewing or stitching processes. For this reason, the manufacturing cycle time and the costs associated therewith can be substantially high. Moreover, to reduce these increased costs, existing upper body protective equipment can instead include decorative markings that are painted or otherwise applied to the surface of the rigid cover. However, these markings have minimum longevity and can be easily scratched or otherwise scraped off the protective equipment, including during normal usage. Such results clearly are undesirable.

Therefore, a need exists for a piece of upper body protective equipment that cushions against powerful blows, allows for the unfettered movement of the wearer's arms in all directions, efficiently dissipates heat from the wearer, decreases the weight of the equipment carried by the wearer, and decreases the manufacturing cycle time and the costs associated therewith.

Protective gear also exists to protect other parts of the body from injury during contact athletic events. Such protective equipment includes, gloves, elbow pads, shin guards, and hip pads. Similar to the upper body protective equipment described above, this protective equipment can include similar structural limitations and thus suffers from the same deficiencies discussed above.

Therefore, a need also exists for protective equipment to cover any part of the body and cushion against powerful blows, allows for the free movement of any of the wearer's limbs in all directions, efficiently dissipates heat from the wearer, decreases the weight of the equipment carried by the wearer, and decreases the manufacturing cycle time and the costs in connection therewith.

SUMMARY OF THE INVENTION

In summary, the invention is a protective garment for a torso. The protective garment includes a protector portion having an outer surface and an inner surface. The protective garment also includes a screen layer disposed below the outer surface.

It is therefore one advantage of the present invention to provide a piece of upper body protective equipment that allows a wearer to move his limbs in all directions and simultaneously provides improved protection for the body of the wearer.

It is another advantage of the present invention to provide a piece of upper body protective equipment that is durable and can withstand a substantial number of blows over a significant period of time.

It is still another advantage of the present invention to provide a piece of upper body protective equipment that dissipates heat from a wearer and allows the wearer to preserve his physical stamina and energy for participating in the sport.

It is yet another advantage of the present invention to provide a piece of upper body protective equipment that is lightweight and allows a wearer to expend less energy carrying the garment.

It is a further object of the present invention to provide a piece of upper body protective equipment that includes internal fasteners which attach separate padding sections of the equipment without providing a hold for opponents or otherwise allowing an opponent's equipment to be caught thereon.

It is yet a further object of the present invention to provide a piece of upper body protective equipment that includes two or more pieces of fabric attached together by a radio frequency weld to decrease the manufacturing cycle time and the costs associated therewith and allows for smaller and more intricate designs.

In accordance with the above and the other advantages of the present invention, a piece of protective equipment is provided for cushioning blows imparted upon the body of a user. In one embodiment, the piece of protective equipment includes a chest protector portion, a back protector portion, and a pair of telescopic shoulder protector portions in connection between the chest protector portion and the back protector portion. Each shoulder protector portion includes an inner-shoulder protector portion and an outer-shoulder protector portion that is telescopically coupled to the mid-shoulder protector portion. Each outer-shoulder protector portion is moveable between an extended position and a retracted position allowing an individual wearing the piece of protective equipment to raise his arm without interference from the protective equipment.

Other advantages of the present invention will become apparent when viewed in light of the detailed description of the preferred embodiment when taken in conjunction with the attached drawings and appended claims.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION OF THE EXEMPLARY EMBODIMENT

Figure 1:
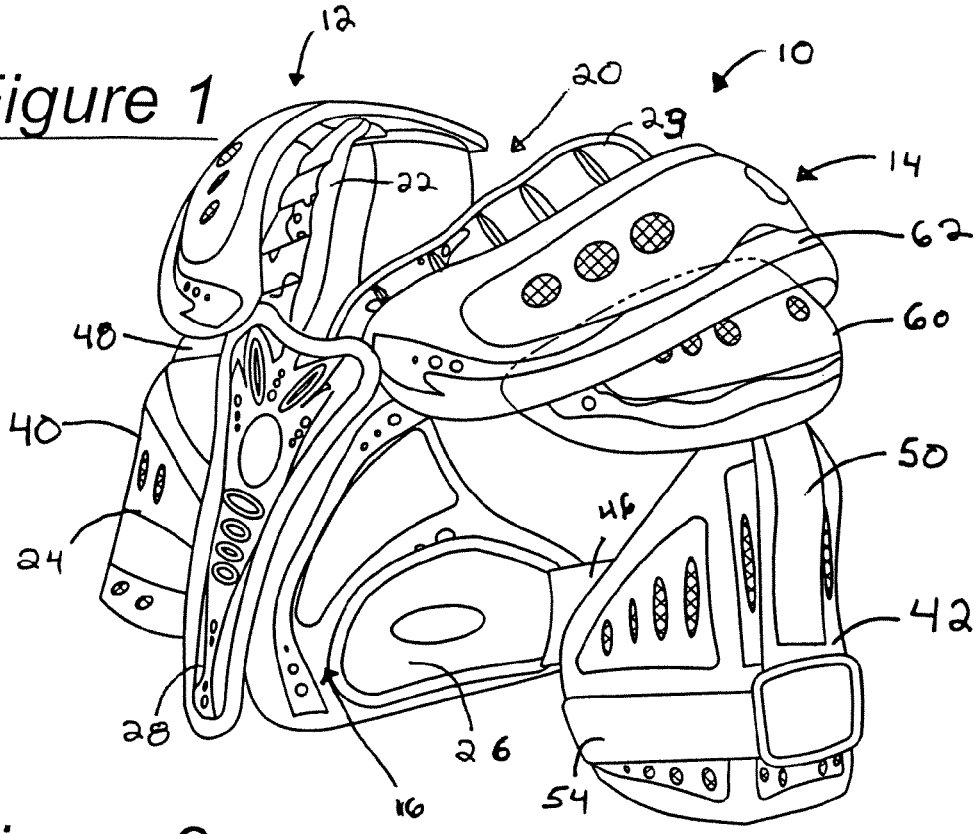
FIG. 1 is a perspective view of a piece of upper body protective equipment in accordance with one embodiment of the present invention.

In the following figures, the same reference numerals are used to identify the same components in the various views.

Referring to FIGS. 1 through 4, there is generally shown a piece of upper body protective equipment 10 ("equipment") worn by a user for the purpose of cushioning against blows delivered to the wearer's upper body such as commonly occurs during a contact sporting event. It will be understood that the disclosed protective garment or equipment is preferably intended for lacrosse. However, it will be understood that the equipment may be used for a variety of other uses, including other contact sports, such as hockey. Although the protective equipment 10 preferably is for protecting the upper body of a wearer, it will be appreciated that the protective equipment may be utilized to protect a variety of different body parts. The protective equipment may, for example, be used to protect a wearer's elbow, shin, hand, wrist, forearm and hip as well as other parts of the body.

The equipment 10 includes a pair of telescopic shoulder protector portions 12, 14 (as discussed in detail in connection with for FIGS. 5A-5B and 6) with a chest protector portion 16 and a back protector portion 18 extending therefrom. Preferably, the pair of telescopic shoulder protector portions 12, 14, the chest protector portion 16, and the back protector portion 18 are configured or assembled as a single unit such that the wearer can put it on as a single unit. The equipment 10 includes an opening 20 generally bounded by the pair of telescopic shoulder protector portions 12, 14, the chest protector portion 16, and the back protector portion 18. The opening 20 is intended to receive a wearer's head and neck therethrough.

As shown in FIGS. 1 through 4, the equipment 10 includes a pair of protective neck portions 22, 23, that, at least in part, underlie and work in connection with the pair of telescopic shoulder protection portions 12, 14, the chest protector portion 16, and the back protector portion 18. The chest protector portion 16 includes a first side protector portion 24, a second side protector portion 26, and a middle protector portion 28. The protective neck portions 22, 23 are secured to a respective telescopic shoulder protection portion 12, 14 by a strap 30, 32 or other suitable attachment device. The back protector portion 18 includes a first side protector portion 34, a second side protector portion 36, and a middle protector portion 38. The first back side protector portion 34 is secured to the protective neck portion 22 by a strap 39 or the like. The second backside protector portion 36 is secured to the protective neck portion 23 by a strap 41 or the like. The protective neck portions 22, 23 are preferably integrally formed with a respective one of the side protector portions 24, 26.

The straps 30,32 are intended to prevent the inner-shoulder protector portion 60 from extending entirely beyond the protective neck portion 22, 23. In this regard, the straps 30, 32 act as a detent member to limit the movement of the inner-shoulder protector portion 60 such that the inner-shoulder protector portion 62 always overlaps at least a minimum amount of the protective neck portion 22, 23 when the outer-shoulder protector portion 60 is in the fully extended position. In that regard, the telescopic shoulder protector portion 12 has a continuous structure for protecting the wearer's entire shoulder when the telescopic shoulder protector portion 12 is disposed in the fully extended position, the fully retracted position, or any position therebetween.

It is noted that a variety of suitable straps 30, 32, other than inelastic strap members, can be utilized to limit the extension of the inner-shoulder portion 60. In addition, it is understood that the straps 30, 32 can attach or otherwise anchor the inner-shoulder protector portion 60 to various structures, including the protective neck portions 22, 23, the chest protector portion 16, the back protector portion 18, or various other suitable structures as desired.

Similarly, the pair of protective neck portions 22, 23 are also preferably secured to a respective one of the side chest protector portions 24, 26. Additionally, the middle chest protector portion 28 is secured to each of the side protector portions 24, 26 such as by hook or loop attachment or an adjustable strap. The telescopic shoulder portions 12, 14 are each secured to a respective side front protector 24, 26 by a strap 43, 45. The telescopic shoulder protector portions 12, 14 are secured to the back protection portion 18 by straps 47, 49 or other suitable attachment devices. Any of the straps or connections between the components can be adjustable straps, flexible straps, elastic straps, hook and loop attachment or other suitable attachment mechanism, which interconnects the various components of the equipment 10. Alternatively, buckles or other suitable attachment mechanism may also be utilized. The attachment of the straps or the securing mechanism to the parts will be understood by one of ordinary skill in the art.

The equipment 10 also preferably includes a pair of arm protector segments 40, 42 extending from each of the telescopic shoulder protector portions 12, 14. These arm protector segments 40, 42 are well known in the art and may be constructed from a variety of different compositions, including foam padding. The arm protector segments 40, 42 also preferably have a plastic covering or shell formed thereon for added protection. Each of the arm protection segments 40, 42 is secured to a respective one of the pair of telescopic shoulder portions 12, 14 by strap 48, 50.

Each of the arm protector segments 40, 42 has a securing strap 52, 54, preferably comprised of elastic, that is intended wrap around a wearer's arm and keep the pad in position. It will be understood that the equipment 10 may take on a variety of different configurations with differently configured or oriented protector portions. Moreover, the protector portions can be secured or otherwise attached to one another in a variety of different ways and at a variety of different points as will be understood by one ordinary skill in the art. Additionally, the front side protector portion 24 is secured to the back side protector portion 24 by a strap 44. Further, the front side protector portion 26 is secured to the back side protector portion 36 by a strap 46. These straps can also be any suitable attachment mechanism.

Figure 5A:
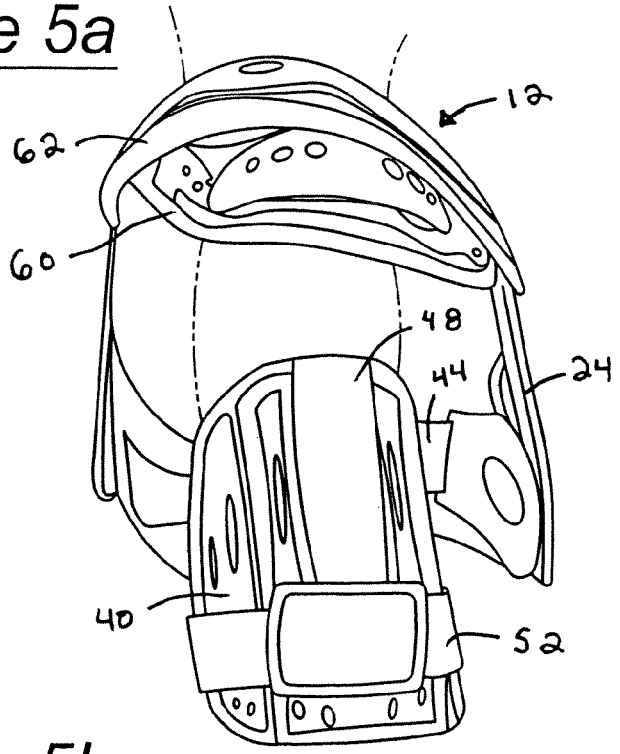
FIG. 5A is a side view of a piece of upper body protective equipment having a telescopic shoulder protector portion with an outer-shoulder protector portion in an extended position relative to an inner shoulder protector portion in accordance with one embodiment of the present invention.
Figure 5B:
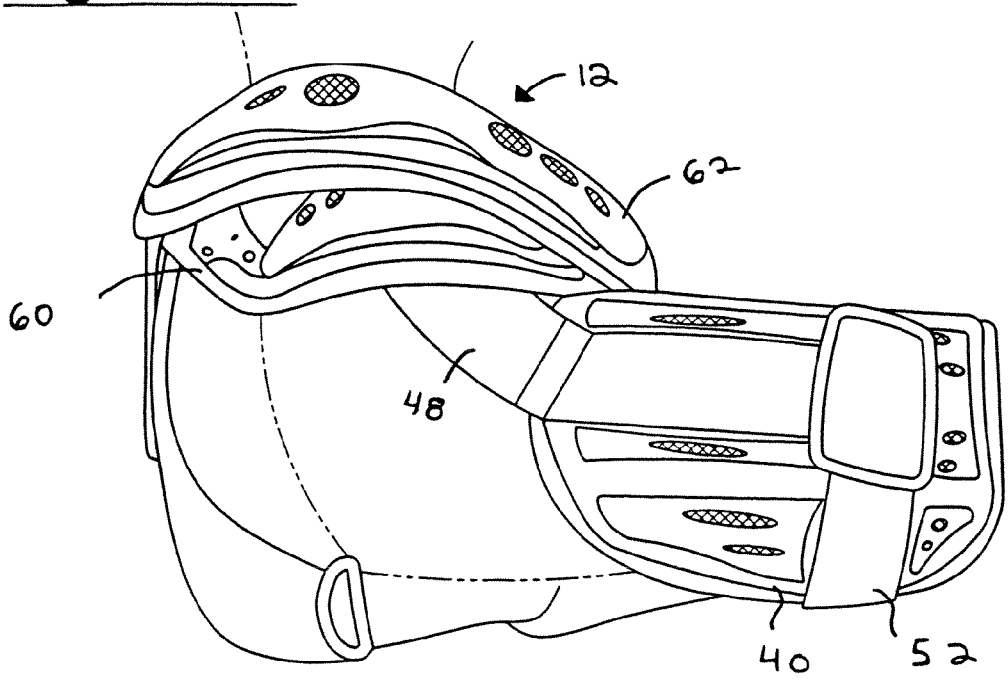
FIG. 5B is a side view of the upper body protective garment shown in FIG. 5B illustrating the outer-shoulder protector portion in a retracted position underneath the inner-shoulder protector portion.

Referring now FIGS. 5A and 5B, there are shown side views of the equipment 10, respectively illustrating one of the telescopic shoulder protector portions 12 in an extended position and a retracted position, in accordance with one embodiment of the present invention. It will be understood by one of ordinary skill in the art that the configuration and operation of the other telescopic shoulder protector portion 14 is the same and thus need not be described in detail separately. This telescopic shoulder protector portion 12 includes the outer-shoulder protector portion 62 and the inner-shoulder protector portion 60. The inner-shoulder protector portion 60 is in telescopic communication with the outer-shoulder protector portion 62. The inner-shoulder protector portion 60 is secured to the protective neck portion 22 by the strap 30 to limit relative movement of the inner-shoulder protector portion 60 with respect to the protective neck portion 22. Obviously, some movement may occur, however, the configuration is intended, in one embodiment, to prevent the inner-shoulder protector portion 60 from overlying a substantial portion of the protective neck portion 22 and impinging on the neck portion 22. However, the strap 30 can be configured to allow more relative movement as desired. This ensures that the outer-shoulder protector portion 62 always at least partially overlies the inner-shoulder protector portion 60 to prevent exposure of a wearer's shoulder.

As shown in FIG. 5A, when the telescopic shoulder portion 12 is in the extended position, i.e. when a wearer's neck and shoulder all the way to the wearer's upper arm are protected from impact and a wearer's arm is not raised. This configuration results from the protective neck portion 22, which has an inner edge that extends to contact or almost contact a wearer's neck and is oriented generally upward to prevent the edge from digging into a player's neck. The protective neck portion 22 is generally fixed in that it has little relative movement with respect to the wearer's neck. The inner-shoulder protector portion 62 is secured to and overlaps an outer edge of the protective neck portion 22 to eliminate any gap therebetween. The outer-shoulder protector portion 62 includes an outer edge which overlies an inner edge of the inner-shoulder protection portion 60.

This overlapping configuration maximizes protection for the user and eliminates any gaps between adjacent segment portions or between a wearer's neck and the equipment. This configuration differs from previous configurations, which in order to allow the shoulder segment to move leaves a gap between the shoulder segment and a wearer's neck, which exposes a portion of the wearer's shoulder or collarbone during play.

FIG. 5B illustrates the telescopic shoulder portion 12 in a retracted position. The telescopic shoulder portion 12 is moveable between an extended position and a fully retracted position in connection with the movement of the wearer's arm. When a wearer begins to raise his arm, the telescopic shoulder portion 12 begins to retract. In other words, the inner-shoulder protector portion 60 moves inwardly with respect to the outer-shoulder protector portion 62 such that the outer-shoulder protector portion 62 overlies a majority, if not all, of the inner-shoulder protector portion 60. This lobster-like coupling of the outer-shoulder protector portion 62 and the inner-shoulder protector portion 60 provides significantly increased flexibility for a wearer without sacrificing protection. This is similar to the shells on a lobster's tail maneuver. It will be understood that the outer-shoulder protective portion 62 can be configured to overlie the inner shoulder protector portion 60 as the telescoping shoulder portion is moved to a retracted position. As the wearer brings his arm down, the strap 48 pulls the inner-shoulder protector portion 60 out from underneath the inner-shoulder protector portion 62 and returns the telescopic shoulder portion 12 to the extended position.

Figure 6:
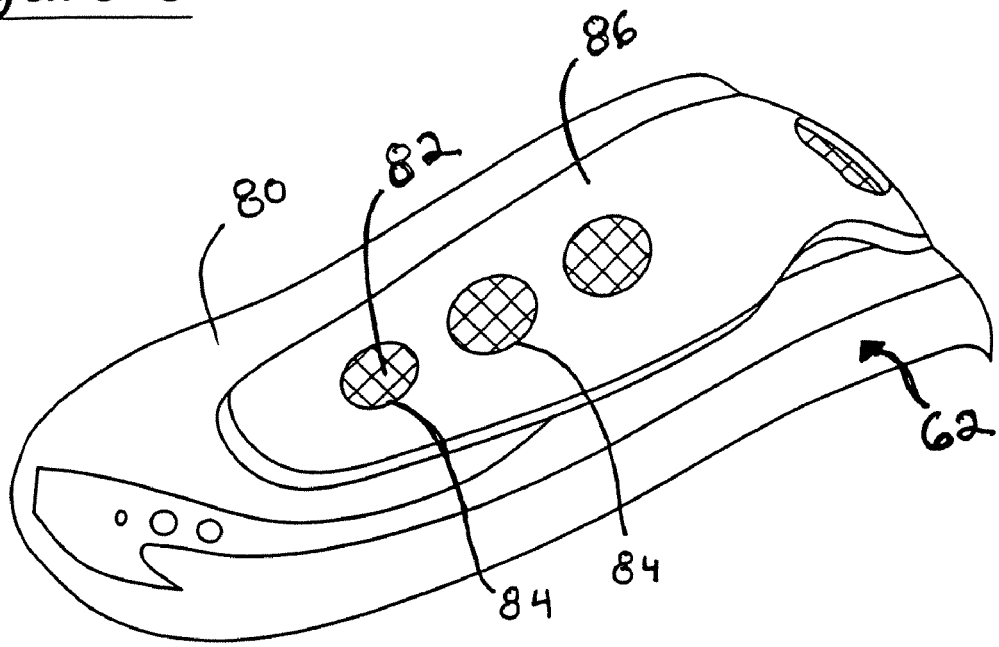
FIG. 6 is an enlarged view of an inner shoulder protector portion in accordance with one embodiment of the present invention.

Referring now to FIG. 6, there is shown a partially cutaway view of the outer-shoulder protector portion 62, in accordance with one embodiment of the present invention. The description of the outer-shoulder protector portion 62 is representative of any of the other protector portions that together comprise the equipment 10. The outer-shoulder protector portion 62 is generally comprised of a foam padding layer 80, a reinforcement wire screen layer 82 positioned above the foam padding layer 80, and a rigid cover 86 overlaying the reinforcement wire screen layer 82 and at least a portion of the foam padding layer 80. The wire screen layer 82 is preferably comprised of a metal material. However, it will be appreciated that the wire screen can be comprised of various other suitable materials as desired. These layers 80, 82, 86 are coupled together by way of stitching. However, it is noted that these layers 80, 82, 86 can be coupled together by various other suitable fastening methods, e.g. adhesive applications. Moreover, the rigid cover 86 is raised with respect to and secured to the surface of the foam padding layer 80.

The combined use of foam padding 82 and the wire screen layer 82 provides the inner-shoulder protector portion 62 with substantial strength without significantly increasing the weight of the equipment 10. Specifically, in comparison to the foam padding, the robust nature of wire screen can provide a greater amount of strength and energy absorbing capability to the mid-shoulder protector portion 62 than the foam padding. In addition, the wire screen layer 82 can withstand a substantially greater number of blows than the foam padding because the foam padding can fatigue more quickly and lose its resiliency after compressing and expanding a particular number of times. For these reasons, a relatively low amount of foam padding can be utilized within the foam padding layer 80 for the purpose of decreasing the overall weight of the equipment 10 without compromising the strength of the structure of the equipment 10. Alternatively, depending upon the thickness of the wire screen layer 82, it may have only a little impact resistance capabilities.

The rigid cover 86 in one embodiment is a plastic piece that is formed by compression molding techniques. This allows for a covering having high strength and light weight. The rigid cover 86 is intended to distribute the force of a delivered blow across a substantial portion of the wire screen layer 82 and the foam padding layer 80. This configuration allows for a substantial amount of the delivered blow to be absorbed by the rigid cover 86 and prolongs the length of the durability of the foam padding for the same reasons discussed above in connection with the wire mesh layer 82 the foam padding. This rigid cover 86 may alternatively be comprised of various other suitable materials.

Furthermore, the rigid cover 86 has a series of openings 84 integrally formed therein for allowing heat to dissipate from the wearer's body through the equipment 10. In particular, heat from the wearer's shoulder can pass through the relatively thin foam padding layer 80, then subsequently through the reinforcement wire screen layer 82, and finally through the openings 84 formed in the rigid cover 86. This construction is beneficial because it can assist the wearer in maintaining his body temperature below a maximum threshold temperature thereby preserving the wearer's physical stamina and energy for participating in the game. The rigid cover 86, the wire screen layer 82, and the openings may also be employed on other portions of the equipment 10, including the chest protector portion 16, the back protector portion 18, the front side protector portions 24, 26, the back side protector portions 34, 36, and the arm protector segments 40, 42.

Figure 7:
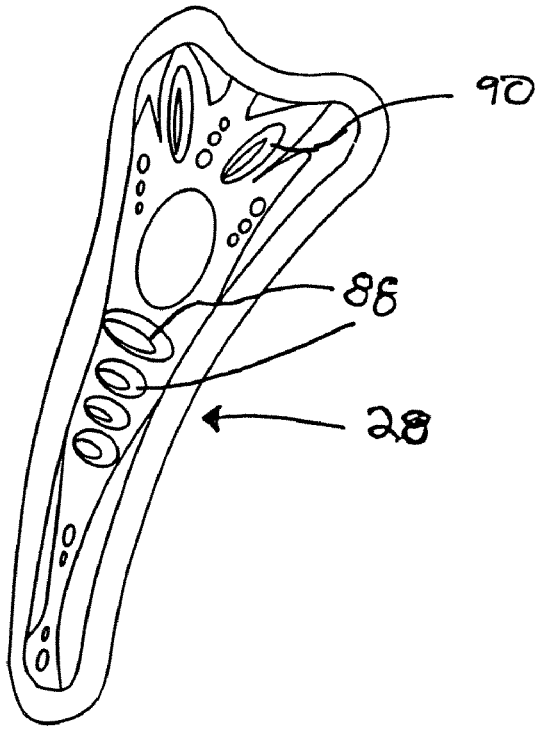
FIG. 7 is an enlarged view of a middle portion of a chest protector portion of a piece of upper body protective equipment in accordance with one embodiment of the present invention.

Referring now to FIG. 7, there is shown a magnified view of the middle chest protector portion 28. This middle chest protector portion 28 includes one or more compression-molded foam elements 88, 90 integrated therein. These compression-molded foam elements 88, 90 have a substantially greater foam density and stiffness than conventional foam padding. Those foam segments 88, 90 are also thicker than conventional foam segments. For that reason, each foam element 88, 90 can absorb a significant amount of energy before the foam element is compressed by the blow delivered to the wearer's body. The compression molded foam elements are preferably positioned in high impact areas to provide a wearer with additional protection. For example, the compression molded foam elements or portions are positioned in the sternum area of the chest. Those of ordinary skill in the art will appreciate that these portions can be positioned in other high impact areas. Although FIG. 7 illustrates the compression-molded foam elements 88, 90 integrated on the middle chest protector portion 28, it will be appreciated that compression-molded foam elements can also be incorporated into the side protector portions 24, 26, the back protector portion 18, the telescopic shoulder protector portions 12, 14, and the arm protector segments 40, 42 or various other parts of the garment 10.

Figure 2:
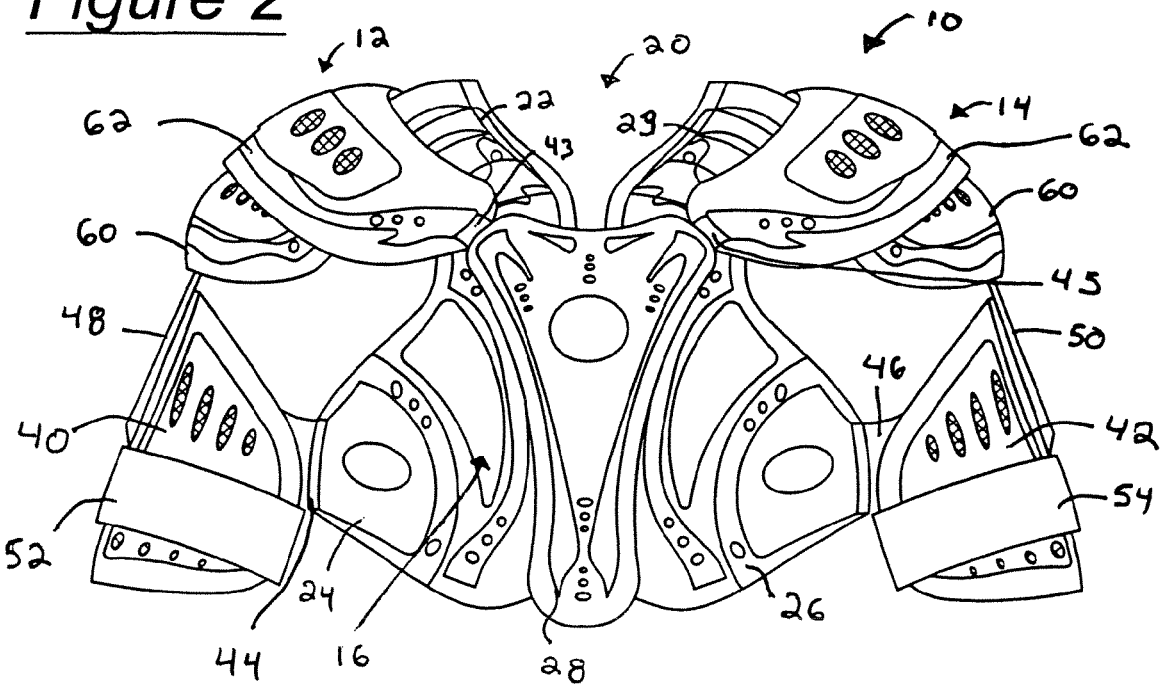
FIG. 2 is a front view of the piece of upper body protective equipment of FIG. 1.
Figure 3:
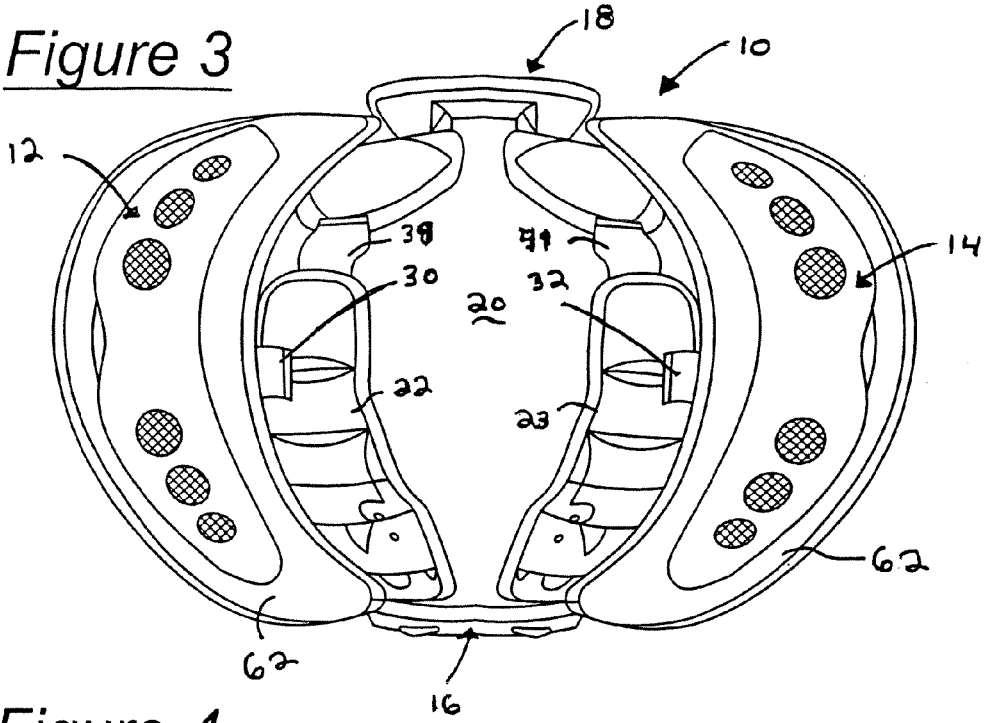
FIG. 3 is a top view of the piece of upper body protective equipment as shown in FIG. 1.
Figure 4:
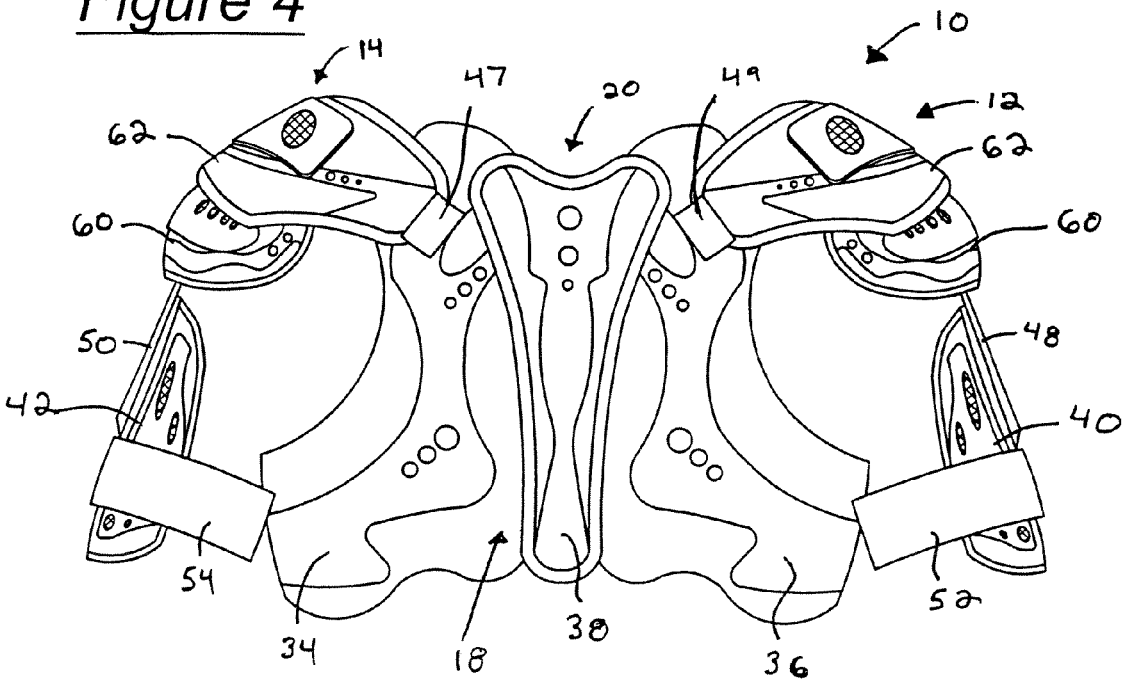
FIG. 4 is a rear view of the piece of upper body protective equipment as shown in FIG. 1.
Figure 8:
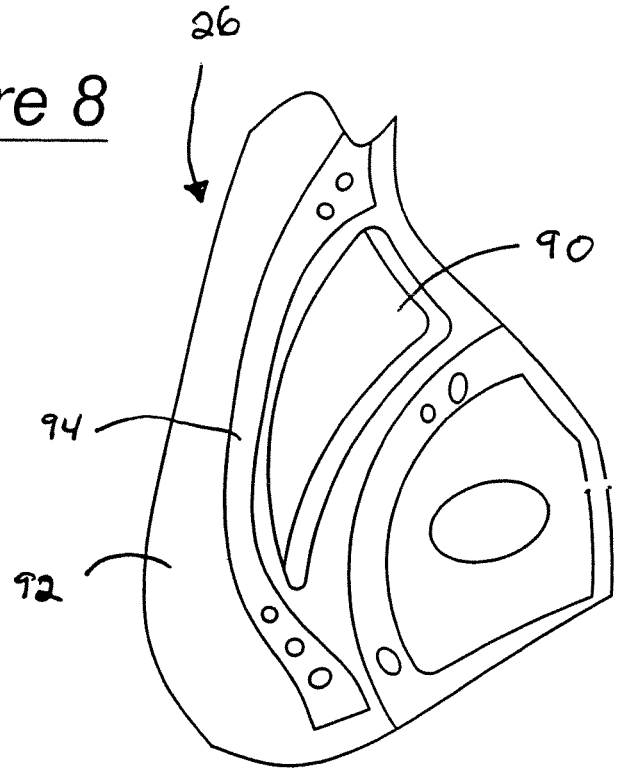
FIG. 8 is an enlarged view of two sections of fabric fastened together by a radio frequency weld in accordance with one embodiment of the present invention.

Turning now to FIG. 8, there is shown a magnified view of the second side front chest protector portion 26 shown in FIG. 2. This second side chest protector portion 26 is covered with two or more decorative fabric pieces 92, 94. These fabric pieces are fastened to each other by way of radio frequency welding techniques to form a bond between the fabric pieces. This feature is beneficial because, in comparison to stitching methods of manufacture, radio frequency welding attaches the fabric pieces 92, 94 together in a relatively short amount of time. As a result, the manufacturing cycle time and the costs associated therewith can be substantially decreased. This radio frequency weld method also allows smaller more intricate designs to be formed in a smaller area without loss of detail or clarity. It is understood that these fabric pieces 92, 94 can be comprised of a variety of materials, e.g. a leather material, and create various designs or markings as desired.

Figure 9:
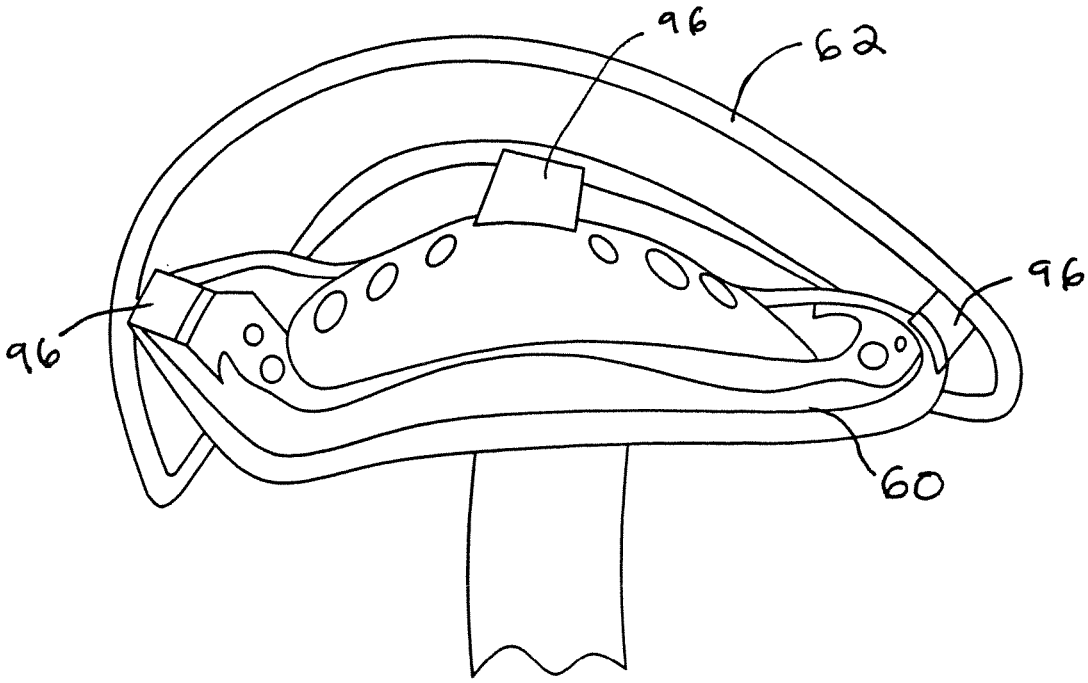
FIG. 9 is a perspective view of a piece of upper body protective equipment having a series of internal belt fasteners for attaching two or more padding sections together in accordance with one embodiment of the present invention.

Referring now to FIG. 9, there is shown an enlarged view of the shoulder protector portion 12. The shoulder protector portion 12 includes a series of inner-side fasteners 96 or detent members for attaching the outer-shoulder protector portion 62 to the inner-shoulder protector portion 60. Specifically, as shown in FIG. 9, the fasteners 96 are woven through apertures to attach the protector portions together. The fasteners 96 also prevent the outer-shoulder protector portion 62 from separating from and moving from a position underlying the inner-shoulder protector portion 60 and exposing a portion of the wearer's shoulder. This construction conceals the fasteners 96 from the exterior of the equipment 10 and consequently contours the exterior of the equipment 10 such that it would be increasingly difficult for an opponent to have a hold on the equipment 10. The fasteners 96 work in connection with the straps 30, 32 to keep padding covering the wearer's entire shoulder throughout a full range of motion. Moreover, it is contemplated that various suitable fasteners other than the belt fasteners can be utilized as desired.

While particular embodiments of the invention have been shown and described, numerous variations and alternate embodiments will occur to those skilled in the art. Accordingly, it is intended that the invention be limited only in terms of the appended claims.

What is claimed is:

1. A protective garment comprising:

a protector portion for a torso having a chest protector portion and a back protector portion, at least one of said chest protector portion and said back protector portion including a rigid outer protective portion and an inner protective portion, said inner protective portion being adjacent a user's torso when worn by the user, said rigid outer protective portion being spaced from the user's torso, said rigid outer protective portion defining at least one opening, said inner protective portion extending across the at least one opening, said rigid outer protective end portion forming at least a portion of an exterior of the protective portion and remaining visible to observers in end use of the protector portion; and a screen layer disposed between said rigid outer protective portion and said inner protective portion, wherein at least a portion of said screen layer is visible through the at least one opening defined by said rigid outer protective portion, wherein the rigid outer protective portion is raised with respect to said screen layer and joined with the screen layer to dissipate a blow to the rigid outer protective portion across at least a portion of the screen layer, wherein heat is dissipated from a user's torso through said inner protective portion, said screen layer, and the at least one opening in said rigid outer protective portion, wherein the screen layer is separately constructed from said rigid outer protective portion but coupled to at least one of said rigid outer protective portion and said inner protective portion.

2. The protective garment of claim 1 wherein said inner protective portion includes a padded portion constructed of a foam material, and wherein said rigid outer protective portion is constructed from a plastic material.

3. The protective garment of claim 1 wherein said screen layer is formed from metal.

4. The protective garment of claim 1 wherein said screen layer extends across said at least one opening.

5. A protective garment comprising:

a protector portion for a torso having a rigid outer cover and an inner padded portion, said protector portion defining an opening in the rigid outer cover that is fully exposed towards the outside of the protective garment; and a screen layer, separately constructed from said rigid outer cover, disposed between said rigid outer cover and said inner padded portion, said screen layer extends across said at least one opening, a first portion of said screen layer being visible through said opening, a second portion of said screen layer being concealed by said rigid outer cover, wherein at least a portion of the rigid outer cover is raised above the screen layer.

6. A protective garment comprising:

a torso protector having an outer surface and an inner surface and defining a chest protector and a back protector, said chest protector including a padded portion constructed of a foam material and a rigid cover disposed over and joined with said padded portion, said chest protector rigid cover being raised with respect to said chest protector padded portion and adapted to dissipate a blow to said chest protector rigid cover over the padded portion, said back protector including a padded portion constructed of a foam material and a rigid cover disposed over and joined with said padded portion, said back protector rigid cover being raised with respect to said back protector padded portion and adapted to dissipate a blow to said back protector rigid cover over the padded portion;

at least one opening defined by said outer surface of at least one of said chest protector and said back protector for dissipating heat through said corresponding padded portion and providing ventilation thereto, said corresponding padded portion extending across the at least one opening; and a mesh layer disposed between said rigid cover and said padded portion in at least one of said chest protector and said back protector, said mesh layer extending across said at least one opening to provide greater energy absorbing capability than said padded portion, said mesh layer being at least partially visible to a view through said at least one opening, wherein said mesh layer is separately constructed from said rigid cover, but coupled to at least one of said rigid cover and said padded portion, wherein said rigid cover is at least partially raised above the mesh layer.

7. The protective garment of claim 6 wherein said at least one opening includes a first opening in said chest protector and a second opening in said back protector, and wherein said mesh layer is further defined to include a first mesh layer portion extending across said first opening and a second mesh layer portion extending across said second opening.

8. The protective garment of claim 6 wherein said at least one opening is further defined as being formed in said rigid cover of at least one of said chest protector and said back protector.

9. The protective garment of claim 6 wherein said at least one opening is further defined as being formed only in said rigid cover of one of said chest protector and said back protector.

10. The protective garment of claim 6 wherein said chest protector and said back protector are elastically attached to one another.

11. The protective garment of claim 6 wherein said mesh layer is further defined as being formed of metal.

12. The protective of claim 6 wherein said mesh layer is located substantially within at least one of said chest protector and back protector without extending into other, separate protector portions of the protective garment that protect other portions of a wearer's body.

13. The protective garment of claim 6 wherein said mesh layer is a metal mesh screen.

14. The protective garment of claim 6 wherein said mesh layer is stitched to said rigid cover in at least one of said chest protector and said back protector.

15. The protective garment of claim 6 wherein said mesh layer is positioned below an outer surface of the rigid cover so that the mesh layer is not engaged when the rigid cover is impacted by a blow.

16. The protective garment of claim 1 wherein said screen layer is a metal mesh screen.

17. The protective garment of claim 1 wherein said screen layer is located substantially within said protector portion without extending into other, separate protector portions of the protective garment that protect other portions of a wearer's body.

18. The protective garment of claim 1 wherein said at least one opening includes a plurality of openings in said outer protective portion, wherein said screen layer extends across all of said plurality of openings.

19. The protective garment of claim 1 wherein said screen layer is stitched to said rigid outer protective portion in at least one of said chest protector and said back protector.

20. The protective garment of claim 1 wherein said screen layer is positioned below an outer surface of the rigid outer protective portion so that the screen layer is not engaged when the rigid outer protective portion is impacted by a blow.

* * * * *